US007350489B2

(12) United States Patent
Engelhardt et al.

(10) Patent No.: US 7,350,489 B2
(45) Date of Patent: Apr. 1, 2008

(54) FINGER LEVER OF A VALVE TRAIN OF AN INTERNAL COMBUSTION ENGINE

(75) Inventors: Helmut Engelhardt, Herzogenaurach (DE); Johann Kecker, Herzogenaurach (DE); Jorg Michel, Schwarzenbach am Wald (DE)

(73) Assignee: INA-Schaeffler KG, Herzogenaurch (DE)

( * ) Notice: Subject to any disclaimer, the term of this patent is extended or adjusted under 35 U.S.C. 154(b) by 481 days.

(21) Appl. No.: 10/532,779

(22) Filed: Apr. 22, 2005

(65) Prior Publication Data

US 2008/0041326 A1 Feb. 21, 2008

Related U.S. Application Data

(63) Continuation of application No. PCT/EP03/11343, filed on Oct. 14, 2003.

(30) Foreign Application Priority Data

Oct. 24, 2002 (DE) ..... 102 49 560

(51) Int. Cl.
*F01L 1/18* (2006.01)

(52) U.S. Cl. ..... 123/90.39; 123/90.45; 74/559

(58) Field of Classification Search ..... 123/90.39, 123/90.44, 90.45, 90.46, 90.48, 90.52, 90.55; 74/559, 567, 569

See application file for complete search history.

(56) References Cited

U.S. PATENT DOCUMENTS 4,934,323 A 6/1990 Grinsteiner
5,775,280 A 7/1998 Schmidt et al.
6,491,012 B2 * 12/2002 Pryba et al. ..... 123/90.41

FOREIGN PATENT DOCUMENTS

| | | |
|---|---|---|
| DE | 1 198 606 | 8/1965 |
| DE | 70 01 470 | 1/1971 |
| DE | 35 00 524 | 7/1985 |
| DE | 297 07 987 | 8/1997 |
| DE | 197 17 981 | 10/1998 |
| DE | 197 30 201 | 1/1999 |
| JP | 63045406 | 2/1988 |
| JP | 2002 155710 | 5/2002 |

* cited by examiner

*Primary Examiner*—Ching Chang
(74) *Attorney, Agent, or Firm*—Charles A. Muserlian

(57) ABSTRACT

A finger lever of a valve train of an internal combustion engine, said finger lever comprising two side walls that are connected to each other by a crossbeam that acts through an underside at one end on at least one gas exchange valve and is mounted at a further end through a concave cavity on a head of a support element, a clip through which the finger lever is fixed in position on said head for displacement in a direction of pivot being applied to said further end, wherein a central section of the clip made of flat material is supported at the further end on the underside of the crossbeam and comprises an opening under the cavity, the head of the support element being retained behind an edge of said opening, each side wall being surrounded on an outer surface by a tab-like extension that starts laterally from the central section and is snapped at an end onto one of an upper side or a support surface substantially parallel to the upper side, so that the end of the extension engages over more than at least one half of a width of the upper side or of the support surface.

13 Claims, 1 Drawing Sheet

FINGER LEVER OF A VALVE TRAIN OF AN INTERNAL COMBUSTION ENGINE

This application is a Continuation of PCT/EP03/11343 filed Oct. 14, 2003.

FIELD OF THE INVENTION

The invention concerns a finger lever of a valve train of an internal combustion engine, said finger lever comprising two side walls that are connected to each other by a crossbeam that acts through an underside at one end on at least one gas exchange valve and is mounted at a further end through a concave cavity on a head of a support element, a clip through which the finger lever is fixed in position on said head for displacement in a direction of pivot being applied to said further end.

BACKGROUND OF THE INVENTION

A finger lever of the pre-cited type is disclosed in DE 35 00 524 C2 that is considered to be generic. A leg of the clip disclosed in this document extends in the direction of extension of the finger lever. During a pivoting motion of the finger lever generated by cam loading, this clip impedes a smooth and easy pivoting motion because bending work has to be performed. This has a detrimental effect on the total amount of frictional loss in the valve train.

OBJECTS OF THE INVENTION

It is an object of the invention to provide a finger lever of the pre-cited type in which the aforesaid drawbacks are eliminated.

This and other objects and advantages of the invention will become obvious from the following detailed description.

SUMMARY OF THE INVENTION

The invention achieves the above objects by the fact that a central section of the clip made of flat material is supported at the further end on the underside of the crossbeam and comprises an opening under the cavity, the head of the support element being retained behind an edge of said opening, each side wall being surrounded on an outer surface by a tab-like extension that starts laterally from the central section and is snapped at an end onto one of an upper side or a support surface substantially parallel to the upper side, so that the end of the extension engages over more than at least one half of a width of the upper side or of the support surface.

In this way, the aforesaid drawbacks are eliminated with simple measures. Despite its connection to the support element, the finger lever can move freely in the direction of pivot. As compared to the initially discussed prior art, the frictional work of the valve train is minimized.

It is also considered to be a particular advantage of the invention that one type of clip can be used on the most different types of finger levers or support elements. This reduces costs. Moreover, the clip is relatively simple to mount. By a fixing (snapping) of the ends of the tab-like extensions of the clip on the upper sides of the side walls, an excellent, inseparable fixing of the clip is guaranteed.

Where appropriate, the ends may also be clipped into a recess of an outer surface of the side wall concerned, or the ends (at least one) may be guided in suitable recesses or between material elevations on the upper sides of the side walls. This effectively prevents a slipping of the clip.

According to a further proposition of the invention, to enable a simple mounting of the clip, at least one extension of the clip comprises a portion that is bent over toward the outer surface of the side wall. Due to this portion, the clip can be excellently widened (if necessary, manually) during mounting and snapped onto the upper surface.

According to still another proposition of the invention, the clip is made preferably of sheet steel or of another resilient material, such as, for example, plastic.

As viewed in cross-sectional direction, the finger lever preferably has a U-shaped configuration. Other, different configurations, such as, for example, an H-shape or a shape only similar to a U are also conceivable.

A further contribution to a reduction of manufacturing costs and minimization of the oscillating mass of the valve train is made by the fact that the finger lever, generally of sheet metal, is preferably configured with thin walls. Particular attention can be drawn in this connection to the fact that the end in the region of the gas exchange valve is configured with a particularly small quantity of mass for minimizing the mass moment of inertia.

Further provisions of the invention concern advantageous configurations of the opening of the central section on the underside of the crossbeam. For example, this opening can have an oval shape in the longitudinal direction of the cam follower, so that the head of the support element is engaged only by the side flanks of the opening.

Alternatively to the above, the opening may also be circular in shape. In this case, to enable an easy mounting of the head of the support element behind the opening, this may be split or comprise tongue-shaped recesses.

The invention will now be described more closely with reference to the appended drawings.

DETAILED DESCRIPTION OF THE DRAWINGS

Figure 1:
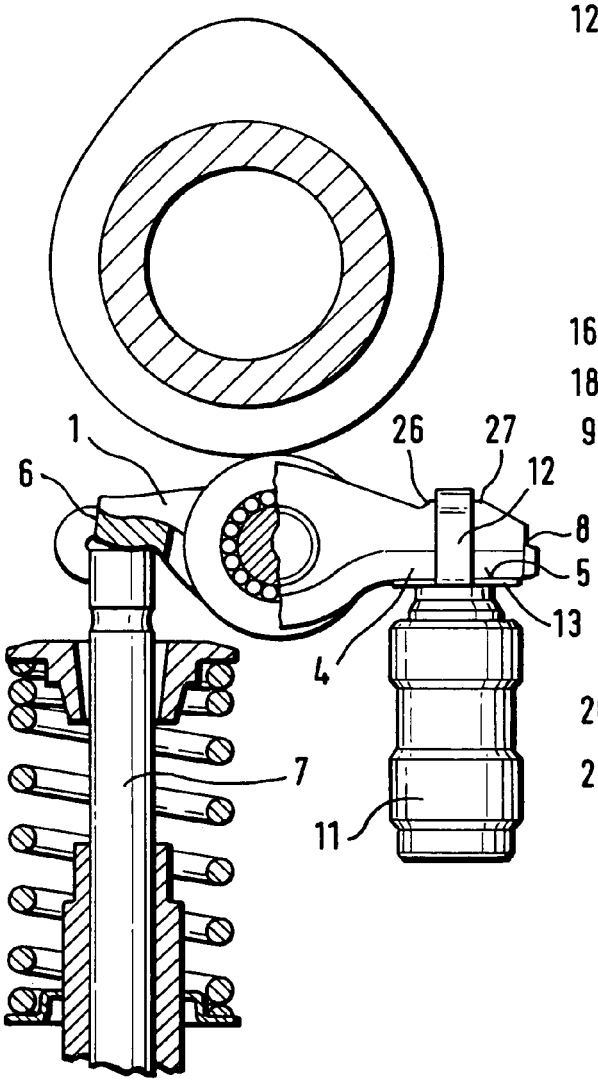
FIG. 1 is a longitudinal view, partly in section, of a finger lever of the invention in the installed state.

The drawings show a finger lever 1 of a valve train of an internal combustion engine. The finger lever 1 comprises side walls 2, 3 that are connected to each other by a crossbeam 4. As viewed in cross-section, the finger lever 1 thus has a U-profile. The finger lever 1 is made preferably of sheet steel by a shaping method.

The crossbeam 4 comprises at one end 6, on an underside 5, a support for at least one gas exchange valve 7. At a further end 8, the crossbeam 4 comprises a concave cavity 9 in which, in the installed state, a head 10 of a support element 11 is mounted. The finger lever 1 is connected to the support element 11 by a clip 12 that guarantees a free movement of the finger lever 1 in its direction of pivot on the head 10.

The clip 12 is made, for instance, of thin-walled sheet steel and is supported through a central section 13 on the underside 5 of the crossbeam 4 in the region of the further end 8 thereof. The central section 13 comprises an opening 14 that is aligned to the cavity 9. The head 10 of the support element 11 is clipped on behind the opening 14 that, as viewed in the longitudinal direction of the finger lever 1, has an oval shape.

A tab-like extension 16, 17 of the clip 12 engages around the outer surface 18, 19 of each side wall 2, 3. Advantageously, these extensions 16, 17 bear directly against the outer surfaces 18, 19 of the side walls 2, 3. Ends 20, 21 of the extensions 16,17 are snapped onto upper surfaces 22, 23 of the side walls 2, 3 to engage over at least a larger part of a width of the side walls 2, 3. To facilitate their assembly, at least one of the extensions 16, 17 comprises, starting from its end 20, 21 extending on the upper surface, an outwardly bent-over portion. In this way, for example during manual assembly, the clip 12 can be simply widened and snapped onto the respective upper surface 22, 23.

Figure 2:
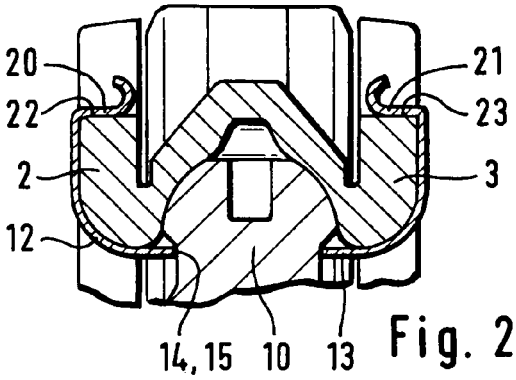
FIG. 2 is an enlarged sectional view through the finger lever of the invention in a region of a cavity for a support element.

FIG. 2 discloses the simplest embodiment of the clip 12, with a symmetric configuration.

Figure 3:
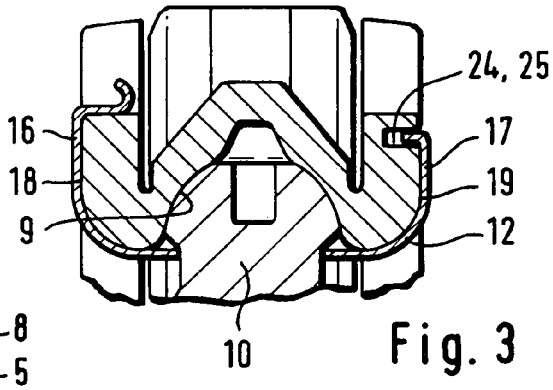
FIG. 3, is another enlarged sectional view through the finger lever of the invention in the region of the cavity for the support element.

According to FIG. 3, the side wall 3, for example, can comprise on its outer surface 19, a slit-like recess 25 extending in the length direction of the lever. This recess 25 comprises a support surface 24 onto which the end 21 of the respective extension 17 is snapped. If desired, both the side walls 2, 3 may be configured in this manner.

Figure 4:
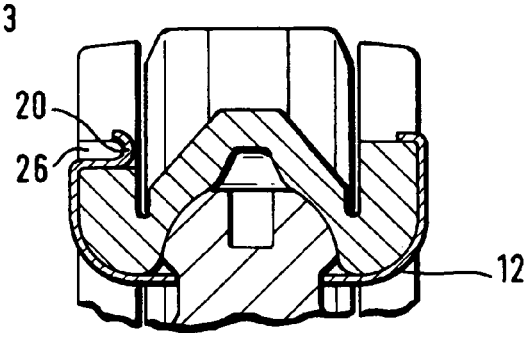
FIG. 4, is still another enlarged sectional view through the finger lever of the invention in the region of the cavity for the support element.

According to FIG. 4, two spaced-apart elevations 26, 27 are arranged on the upper surface 22 of at least the side wall 2 (s. FIG. 1). The end 20 of the extension 16 extends between these elevations 26, 27. In this way, an excellent anti-displacement device is formed for the clip 12 on the finger lever 1.

Figure 5:
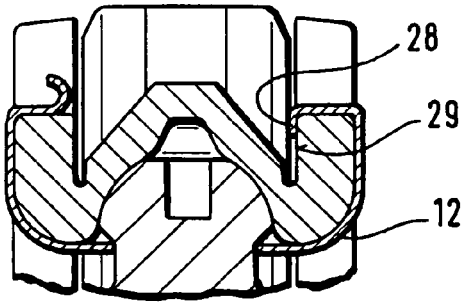
FIG. 5, is still another enlarged sectional view through the finger lever of the invention in the region of the cavity for the support element

Alternatively, according to FIG. 5, the clip 12 may be snapped with an end portion 28 behind an inner surface 29 of the side wall 3.

It goes without saying that combinations of the aforesaid fixing measures will also occur in this context to a person skilled in the art.

Due to the fact that, with the help of the clip 12, a very simple connection is realized between the finger lever 1 and the support element 11, which may also be designed to operate hydraulically, a fully pre-assembled unit can be delivered to the engine manufacturer and be installed by him in the internal combustion engine without further assembly work. Further, an excellent safety device to prevent a canting of the finger lever 1 on the head 10 of the support element 11 is realized. This connection is preferably intended to be maintained over the entire operating life of the internal combustion engine.

The invention claimed is:

1. A finger lever of a valve train of an internal combustion engine, said finger lever comprising two side walls that are connected to each other by a crossbeam that acts through an underside at one end on at least one gas exchange valve and is mounted at a further end through a concave cavity on a head of a support element, a clip through which the finger lever is fixed in position on said head for displacement in a direction of pivot being applied to said further end, wherein a central section of the clip made of flat material is supported at the further end on the underside of the crossbeam and comprises an opening under the cavity, the head of the support element being retained behind an edge of said opening, each side wall being surrounded on an outer surface by a tab-like extension that starts laterally from the central section and is snapped at an end onto one of an upper side or a support surface substantially parallel to the upper side, so that the end of the extension engages over more than at least one half of a width of the upper side or of the support surface.

2. A finger lever of claim 1, wherein at least one of the side walls comprises on the outer surface, slit-like recess extending in length direction of the finger lever for forming the support surface onto which the end of one of the extensions of the clip is snapped.

3. A finger lever of claim 1, wherein at least one of the side walls comprises on the upper side, an elevation that is enclosed at least on one side by the end of one of the extensions of the clip.

4. A finger lever of claim 1, wherein at least one of the side walls comprises on the upper side, a depression in which the end of one of the extensions of the clip is guided.

5. A finger lever of claim 1, wherein at least one of the side walls comprises on the upper side, two elevations between which the end of one of the extensions of the clip is guided.

6. A finger lever of claim 1, wherein the end of at least one of the extensions of the clip engages completely over the upper side of one of the walls and is snapped with an end portion behind an inner surface of said one of the walls.

7. A finger lever of claim 1, wherein at least one of the extensions of the clip comprises a portion which, starting from the end that extends on the upper side or on the support surface, is bent over toward the outer surface of the side wall, said portion being spaced from said end that extends on the upper side or on the support surface.

8. A finger lever of claim 1, wherein the clip is made of a resilient material.

9. A finger lever of claim 8, wherein the resilient material is chosen from the group consisting of sheet steel, plastic, fiber-reinforced plastic and particle-reinforced plastic.

10. A finger lever of claim 1, wherein the finger lever has a generally U-shaped cross-section and is made of sheet metal.

11. A finger lever of claim 1, wherein the opening of the central section on the underside of the crossbeam has an oval shape as viewed in length direction of the finger lever, the head of the support element being clipped or snapped behind the edge of the opening.

12. A finger lever of claim 1, wherein the opening of the central section on the underside of the crossbeam has a circular split configuration, the head of the support element being clipped or snapped behind the edge of the opening.

13. A finger lever of claim 1, wherein the opening of the central section on the underside of the crossbeam has a circular configuration comprising resilient, tongue-like recesses, the head of the support element being clipped or snapped behind the edge of the opening.

* * * * *